US006052101A

United States Patent [19]

Moon

[11] Patent Number: 6,052,101

[45] Date of Patent: Apr. 18, 2000

[54] CIRCUIT OF DRIVING PLASMA DISPLAY DEVICE AND GRAY SCALE IMPLEMENTING METHOD

[75] Inventor: Seong Hak Moon, Kyungki-do, Rep. of Korea

[73] Assignee: LG Electronics Inc., Seoul, Rep. of Korea

[21] Appl. No.: 08/904,256

[22] Filed: Jul. 31, 1997

[30] Foreign Application Priority Data

Jul. 31, 1996 [KR] Rep. of Korea ..... 96-31726
Apr. 1, 1997 [KR] Rep. of Korea ..... 97-12018

[51] Int. Cl.[7] ..... G09G 3/28

[52] U.S. Cl. ..... 345/60

[58] Field of Search ..... 345/55, 60, 63, 345/67, 89, 97, 103, 147; 348/797

[56] References Cited

U.S. PATENT DOCUMENTS

| | | | |
|---|---|---|---|
| 5,420,602 | 5/1995 | Kanazawa | 345/67 |
| 5,436,634 | 7/1995 | Kanazawa | 345/67 |
| 5,475,448 | 12/1995 | Saegusa | 348/797 |
| 5,541,618 | 7/1996 | Shinoda . | |
| 5,583,527 | 12/1996 | Fujisaki et al. | 345/55 |
| 5,684,499 | 11/1997 | Shimizu et al. | 345/60 |
| 5,724,053 | 3/1998 | Nagakubo | 345/60 |
| 5,745,086 | 4/1998 | Weber | 345/63 |
| 5,757,343 | 5/1998 | Nagakubo | 345/63 |
| 5,790,095 | 8/1998 | Onodera et al. | 345/147 |
| 5,818,419 | 10/1998 | Tajima et al. | 345/147 |
| 5,835,072 | 11/1998 | Kanazawa | 345/60 |
| 5,874,932 | 2/1999 | Nagaoka et al. | 345/60 |
| 5,889,501 | 3/1999 | Sasaki et al. | 345/60 |

*Primary Examiner*—Matthew Luu
*Assistant Examiner*—Jeff Piziali

[57] ABSTRACT

Driving circuit for plasma display device and a gray scale implementing method therefor are provided. The method includes the steps of (1) dividing total horizontal lines of one frame into X×Y subframes according to a relative luminance ratio, (2) dividing each frame into X subfields and allotting Y different subframes to each subfield, and (3) supplying corresponding gray scale data while sequentially erasing each X×Y horizontal lines during one horizontal period from the first horizontal electrode lines to the last Nth horizontal electrode lines, included in Y different subframes allotted to each subfield by repeatedly driving X subfields and scanning the same, thereby implementing a display picture of $2^{X \cdot Y}$ gray scales. At least two scanning and sustaining drivers are provided, and one frame is divided into one or more subfields by the drivers, different subframes are allotted to each subfield and then X subfields are repeatedly driven. In other words, since a plurality of horizontal lines to be scanned at a time in a sub-frame method are separately scanned, the overall scanning frequency is decreased. Thus, gray scales exceeding 256 levels can be easily implemented under a stabilized system. Also, flickers caused by the sub-field method can be eliminated. Further, luminance and contrast of a display picture can be improved.

14 Claims, 7 Drawing Sheets

CIRCUIT OF DRIVING PLASMA DISPLAY DEVICE AND GRAY SCALE IMPLEMENTING METHOD

BACKGROUND OF THE INVENTION

1. Field of the Invention

The present invention relates to a plasma display device, and more particularly, to a driving circuit of a plasma display device for implementing gray scales by performing scanning in a sub-frame method after dividing a frame into at least two subfields.

2. Description of the Related Art

As the current society has become more information-oriented, the desire for development and distribution of information processing systems has recently increased. Thus, the importance of picture display devices has become increased and the kinds thereof has become gradually varied.

Conventional CRTs (cathode-ray tubes) which have been widely used have several problems such as large size, high operational voltage, display distortion and the like. Thus, they are not suitable for the demand for realization of a large-scale and flat screen. Currently, various flat display devices having matrix structures are being studied and developed.

Among the flat display devices, a plasma display device having an alternating current plasma display panel (AC PDP) which is an emitting type element, displays motion pictures or still pictures by using a gas discharge phenomenon of the AC PDP.

In the plasma display device, discharge is achieved by adjusting voltages between vertical and horizontal electrodes of a cell composing a pixel. The amount of discharged light changes to adjust the length of discharge time in the cell. The overall screen is obtained by driving in a matrix type a write pulse for inputting a digital picture signal to vertical and horizontal electrodes of the respective cells, a scan pulse for scanning, a sustain pulse for sustaining discharge, and an erase pulse for terminating discharge of a discharged cell. Also, a gray scale is implemented by differentiating the length of discharge time of each cell for a predetermined time (e.g., 1/30 sec in an NTSC Television signal) required for displaying the entire picture.

The luminance of a screen is determined by the brightness for the case when each cell is driven to a maximum level. To increase the luminance, a driving circuit must be constructed such that the discharge time of a cell can be maintained as long as possible for a predetermined time required for forming a screen. Contrast which is a difference in light and darkness is determined by brightness and luminance of a background such as illumination. To increase the contrast, the background must be dark and the luminance thereof must be increased.

FIG. 1 is a structural view of an electrode of an AC PDP included in a conventional plasma display device, in which M vertical electrode lines $D_1$ to $D_M$ and N horizontal electrode lines $S_1$ to $S_N$.

In the AC PDP, the corresponding cell is discharged such that voltages applied between a vertical electrode line and a horizontal electrode line are adjusted. Also, the gray scale of a picture displayed in each cell is implemented by adjusting the discharge sustaining time of the cell.

As a method for implementing the gray scale of the displayed picture, there is a subfield method. According to the gray scale implementing method using the subfield method, a frame is divided into X subfields and a luminance value proportional to a relative luminance ratio (1:2:4:8:16:32:64: . . . ) is allotted to each subfield to then display a picture of $2^X$ gray levels by the combination of the respective subfields, which is disclosed in U.S. Pat. No. 5,541,618.

For example, as shown in FIG. 2, one frame is divided into four subfields sf1, sf2, sf3 and sf4, and the corresponding gray scale data are supplied to the entire cells for each subfield. Then, if sustain pulses of the number proportional to the relative luminance ratio 1:2:4:8 are supplied, the picture of $2^4$ (=16) gray scale levels is displayed.

In other words, if one sustain pulse is supplied when a first subfield sf1 is driven, two, four and eight sustain pulses are supplied, respectively, when second to fourth subfields sf2 to sf4 are driven.

However, the above-described gray scale implementing method using the subfield method has limitation in that a write pulse cannot be applied to one or more horizontal electrodes once with respect to a given vertical electrode since the PDP must be driven by a matrix method. Accordingly, horizontal electrodes must be driven at different timings from each other. Therefore, a time for scanning all horizontal electrodes is required for forming the respective subfields. The respective cells can sustain discharge only for a reduced time by a scanning time from the average time allotted to the respective subfields. At this time, the time required for scanning is increased as the number of horizontal electrodes are increased. Since the discharge cannot be sustained for the time, the luminance and contrast of the PDP are lowered. Also, in forming subfields, a discharge time difference between upper and lower bits is large. Also, a plurality of subfields are sequentially driven for displaying a picture of one frame. In this case, since a procedure of maintaining discharge emission during a relevant period by discharge and emitting the corresponding cell after erasing the entire cells every driving time of each subfield, a flicker is generated due to the discharge time difference.

To solve the problems caused in the subfield method, research into a method for implementing a gray scale using a subframe method corresponding to the subfield method are being actively made.

According to the gray scale implementing method using the sub-frame method, the total horizontal lines of one frame are divided into X blocks depending on a relative luminance ratio so that horizontal lines of the number proportional to the relative luminance ratio may belong to each block. Then, while each X horizontal lines from the first horizontal line to the one right before the last horizontal line, included in each block, are sequentially scanned at a time, the corresponding gray scale data are supplied, thereby displaying a picture of $2^X$ gray levels. At this time, each block is called a subframe.

For example, as shown in FIG. 3, assuming that the total horizontal electrode lines of one frame are 15, one frame is divided into four subframes SF1, SF2, SF3 and SF4 according to a relative luminance ratio 1:2:4:8. Eight horizontal lines 1 to 8, four horizontal lines 9 to 12, two horizontal lines 13 and 14 and one horizontal line 15 are included in the first, second, third and fourth subframes SF1, SF2, SF3 and SF4, respectively.

As described above, in a state where one frame is divided into four subframes SF1 to SF4, the first subframe SF1 sequentially scans each four horizontal lines, from the horizontal line 1 ($S_1$) to the horizontal line 15 ($S_{15}$), at a time, the second sub-frame SF2 from the horizontal line 9 ($S_9$) to the horizontal line 8 ($S_8$), the third subframe SF3 from the horizontal line 13 ($S_{13}$) to the horizontal line 12 ($S_{12}$), and the fourth subframe SF4 from the horizontal line 15 ($S_{15}$) to the horizontal line 14 ($S_{14}$). In the meanwhile, if the corresponding gray scale data are supplied, a display picture of $2^4$ (=16) gray scale levels is implemented.

A driving circuit of a plasma display device for implementing 16 gray scale levels using the sub-frame method, as shown in FIG. 4, includes a microprocessor (to be referred to as a micom, hereinafter) 120 for digitizing analog picture data to output digital picture data and outputting various control signals according to the digital picture data and external signals, a scanning and sustaining driver 130 for sequentially erasing each four lines for every 1/15 frame (to be referred to as one horizontal period, hereinafter) from the first horizontal lines to the last fifteenth ones, included in each four subframes SF1, SF2, SF3 and SF4, scanning the same, and supplying sustain pulses for sustaining discharge to the scanned horizontal electrode lines, a memory 140 for storing the digital picture data output from the micom 120 by frames, colors and bits, and an address driver 150 for receiving bit values of 20 digital picture data corresponding to the horizontal electrode line currently scanned by the scanning and sustaining driver 130 from the memory 140 and supplying the same to 20 vertical electrode lines $D_1$ to $D_{20}$ formed in an AC PDP 10, respectively.

The driving circuit of the plasma display device having the aforementioned configuration operates as follows.

First, the micom 120 digitizes externally input analog picture data to then output 4-bit digital picture data $B_1$ to $B_4$ and outputs various control signals according to the digital picture data $B_1$ to $B_4$ and external signals.

At this time, the digital picture data output from the micom 120 are stored in the memory 140 by frames, colors and bits.

Thereafter, according to the control signals output from the micom 120, the scanning and sustaining driver 130 repeatedly turns the entire screen of the AC PDP 10 on and off, thereby forming a wall charge within the discharge space of each cell. Then, each four lines from each first horizontal electrode lines $S_1$, $S_9$, $S_{13}$ and $S_{15}$ to the last fifteenth horizontal electrode lines $S_{15}$, $S_8$, $S_{12}$ and $S_{14}$, included in the first to fourth subframes SF1 to SF4, respectively, are sequentially erased and then scanned.

The address driver 150 supplies to 20 vertical electrode lines $D_1$ to $D_{20}$ bit values of 20 digital picture data corresponding to the horizontal electrode line currently scanned by the scanning and sustaining driver 130, thereby displaying a picture of 16 (=$2^4$) gray scale levels on the AC PDP 10.

At this time, the scanning and sustaining driver 130 sequentially scans each four horizontal electrode lines with a predetermined time interval for every horizontal period. Also, the scanning and sustaining driver 130 scans the respective horizontal electrode lines $S_1$ to $S_{15}$ and then supplies sustain pulses, so that a logic 'high' signal is supplied through the corresponding vertical electrode line among 20 cells corresponding to the respective horizontal electrode lines $S_1$ to $S_{15}$. Thus, the discharge and emission of partial cells experiencing address discharge are sustained for a predetermined time.

The scanning sequence of the respective horizontal electrode lines $S_1$ to $S_{15}$ is tabulated in the following table 1.

TABLE 1

| | Horizontal period | | | | | | | | | | | | | | |
|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 |
| SF1 | $S_1$ | $S_2$ | $S_3$ | $S_4$ | $S_5$ | $S_6$ | $S_7$ | $S_8$ | $S_9$ | $S_{10}$ | $S_{11}$ | $S_{12}$ | $S_{13}$ | $S_{14}$ | $S_{15}$ |
| SF2 | $S_9$ | $S_{10}$ | $S_{11}$ | $S_{12}$ | $S_{13}$ | $S_{14}$ | $S_{15}$ | $S_1$ | $S_2$ | $S_3$ | $S_4$ | $S_5$ | $S_6$ | $S_7$ | $S_8$ |
| SF3 | $S_{13}$ | $S_{14}$ | $S_{15}$ | $S_1$ | $S_2$ | $S_3$ | $S_4$ | $S_5$ | $S_6$ | $S_7$ | $S_8$ | $S_9$ | $S_{10}$ | $S_{11}$ | $S_{12}$ |
| SF4 | $S_{15}$ | $S_1$ | $S_2$ | $S_3$ | $S_4$ | $S_5$ | $S_6$ | $S_7$ | $S_8$ | $S_9$ | $S_{10}$ | $S_{11}$ | $S_{12}$ | $S_{13}$ | $S_{14}$ |

The address driver 150 supplies the least significant bit $B_1$ among corresponding 20 digital picture data to the vertical electrode lines $D_1$ to $D_{20}$ while 15 horizontal electrodes lines $S_1$ to $S_{15}$ are sequentially scanned to the first subframe SF1, supplies the most significant bit $B_4$ while 15 horizontal electrodes lines $S_9$ to $S_8$ are sequentially scanned to the second subframe SF2, supplies the third bit $B_3$ while 15 horizontal electrodes lines $S_{15}$ to $S_{14}$ are sequentially scanned to the third subframe SF3, and supplies the second bit $B_2$ while 15 horizontal electrodes lines $S_{15}$ to $S_{14}$ are sequentially scanned to the fourth subframe SF4.

Now, in the case of the horizontal electrode line $S_1$, for example, the bit values of the digital picture data supplied to the respective horizontal electrodes lines $S_1$ to $S_{15}$ during one frame (1 to 15 horizontal periods) will be explained. From the above Table 1, the horizontal electrode line $S_1$ is scanned during the horizontal periods 1, 2, 4 and 8, respectively, so that 4-bit digital picture data are supplied in the unit of bits. During the horizontal period 1, the bit $B_1$ having a weight value $2^0$ (=1) is supplied so that emission is maintained during the horizontal period 1 until the horizontal electrode line $S_1$ is scanned during the horizontal period 2. During the horizontal period 2, the bit $B_2$ having a weight value $2^1$ (=2) is supplied so that emission is maintained until the horizontal electrode line $S_1$ is scanned during the horizontal period 4. During the horizontal period 4, the bit $B_3$ having a weight value $2^2$ (=4) is supplied so that emission is maintained until the horizontal electrode line $S_1$ is scanned during the horizontal period 8. During the horizontal period 8, the bit $B_4$ having a weight value $2^4$ (=16) is supplied so that discharge is maintained until the horizontal electrode line $S_1$ is scanned during the horizontal period 1 of the next frame. Therefore, the picture of 16 gray scale levels is displayed on 20 cells corresponding to the horizontal electrode line 1 $S_1$.

Different sustaining periods of the gray scale data are also true of the horizontal electrodes 2 to 15 $S_2$ to $S_{15}$, so that the picture of 16 gray scale levels is displayed on 20 cells corresponding thereto, respectively.

Also, in the case of implementing $2^8$ (=256) gray scales using the sub-frame method, while 8 horizontal electrode lines are sequentially scanned during the horizontal period 1, the corresponding gray scale data must be supplied. Further, in the case of implementing $2^{16}$ (=65536) gray scales using the sub-frame method, while 16 horizontal electrode lines are sequentially scanned during the horizontal period 1, the corresponding gray scale data must be supplied. At this time, in the case of a motion picture, the time required for displaying the picture of one frame (to a narrow sense, one horizontal period for scanning 16 horizontal electrode lines) is all the same irrespective of gray scales to be implemented. Thus, the scanning frequency for 65536 gray scale implementation is double that for 256 gray scale implementation. In other words, the more the gray scales to be implemented, the more the horizontal electrodes lines must be scanned during one horizontal period. Thus, if a motion picture is supplied externally, as the gray scales to be implemented become more, the scanning frequency of horizontal electrode lines is increased.

Therefore, the sub-frame method has the following shortcomings. Since the scanning frequency of horizontal electrode line is increased according to the increase in gray scales, the system becomes destabilized and power consumption is increased. Also, since the number of horizontal electrode lines scanned by a scanning and sustaining driver during one horizontal period is limited, it is difficult to realize gray scales more than 256.

SUMMARY OF THE INVENTION

To solve the above problems, it is an object of the present invention to provide a circuit for driving a plasma display device, having at least two scanning and sustaining drivers, and which can decrease the scanning frequency of horizontal electrode lines by dividing and allotting subframes to the respective scanning and sustaining drivers.

It is another object of the present invention to provide a gray scale implementing method for a plasma display device, by which the overall scanning frequency is decreased by performing a sub-frame method after dividing one frame into at least two subfields, thereby easily implementing gray scales exceeding 256.

Accordingly, to achieve the first object, there is provided a circuit for driving a plasma display device according to the present invention, comprising a memory for dividing one frame into X subfields, dividing total horizontal lines of one frame into X×Y subframes according to a relative luminance ratio and then allotting Y different subframes to the respective subfields, and X scanning and sustaining drivers for sequentially erasing each Y lines for every $\frac{1}{2}^{X \cdot Y}-1$ frame from the first horizontal electrode lines to the last Nth horizontal electrode lines, included in Y different subframes allotted to the respective subfields, scanning the same and supplying sustain pulses for sustaining discharge in scanned horizontal electrode lines.

To achieve the second object, there is provided a gray scale implementing method for a plasma display device according to the present invention, wherein one frame is divided into at least two subfields, different subframes are allotted to the respective subfields, and then a plurality horizontal lines to be scanning during one horizontal period are divided to then be scanned in driving the respective subfields.

BRIEF DESCRIPTION OF THE DRAWING(S)

The above objects and advantages of the present invention will become more apparent by describing in detail a preferred embodiment thereof with reference to the attached drawings in which.

DESCRIPTION OF THE PREFERRED EMBODIMENT(S)

Preferred embodiments of the present invention will now be described in detail with reference to accompanying drawings.

Figure 1:
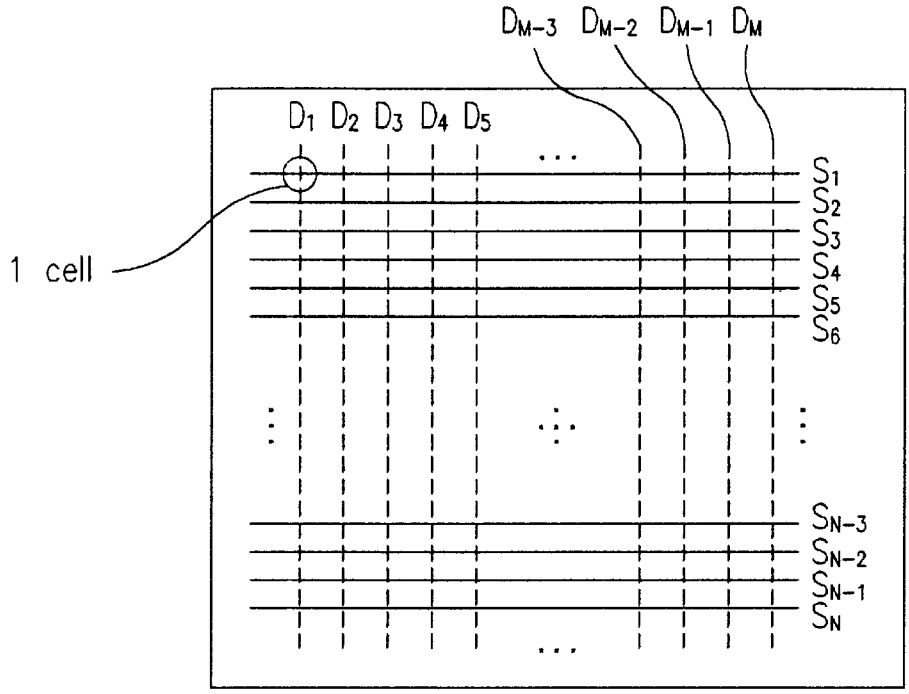
FIG.1 conventional art
FIG. 1 is a structural view of an electrode for a general alternating current plasma display panel (AC PDP)
Figure 2:
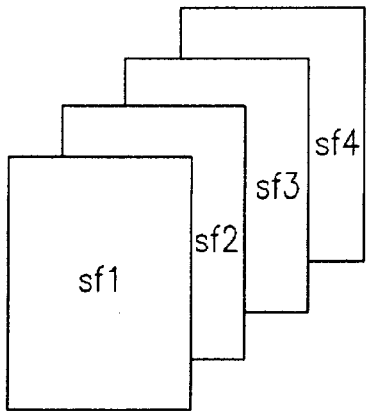
FIG.2 prior art
FIG. 2 is a view diagram illustrating 16 gray scale implementation using a conventional sub-field method.
Figure 3:
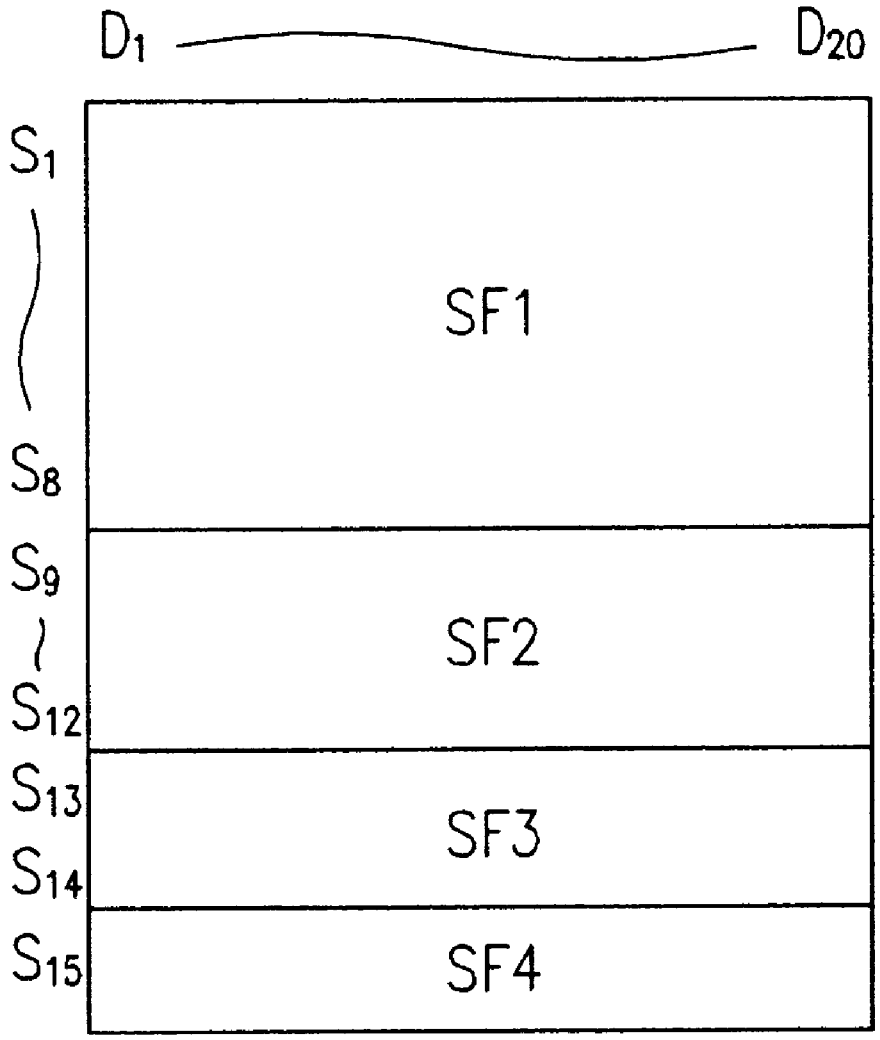
FIG.3 prior art
FIG. 3 is a view diagram illustrating 16 gray scale implementation using a conventional sub-frame method.
Figure 4:
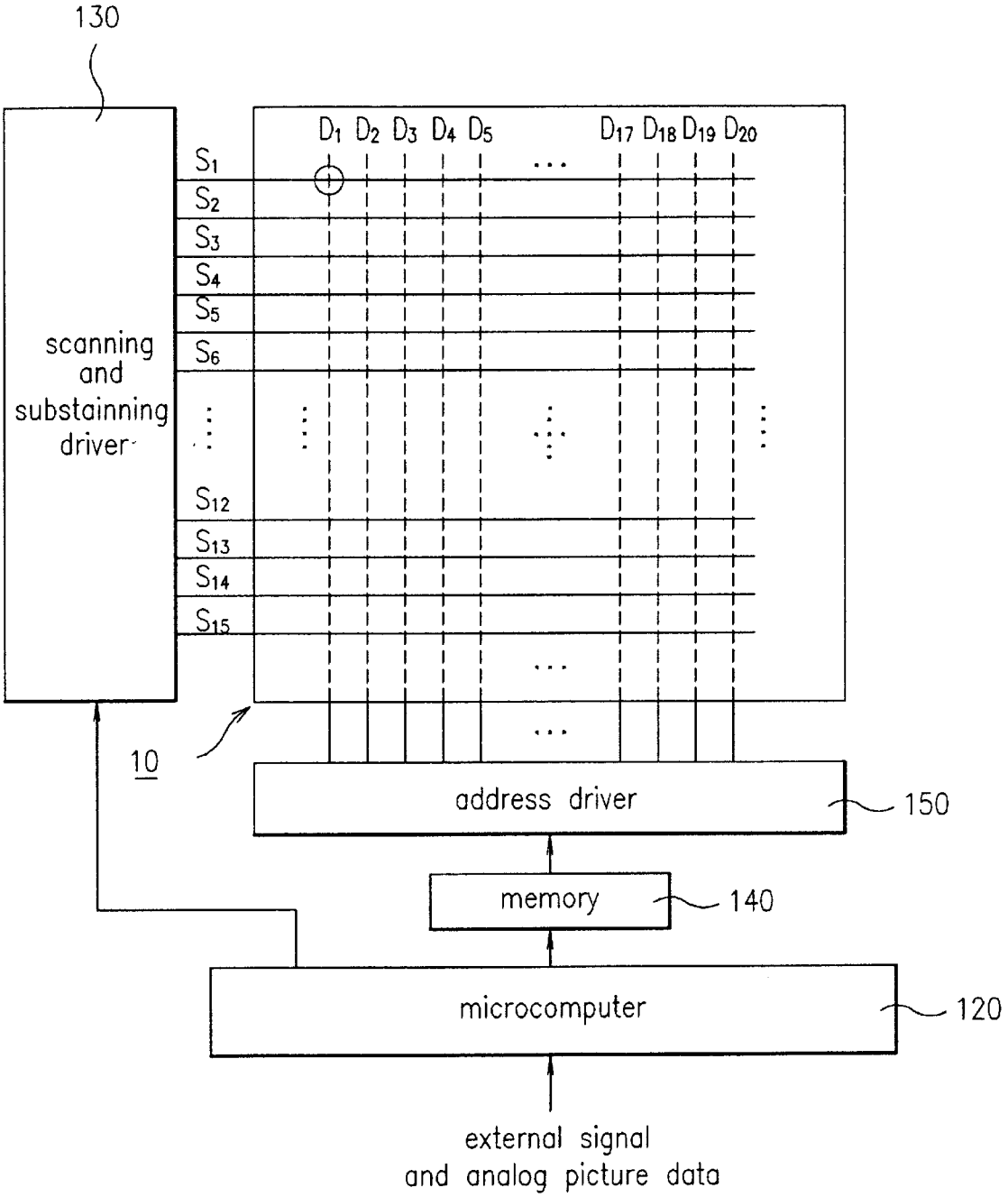
FIG.4 prior art
FIG. 4 is a schematic block diagram of a conventional circuit for driving a plasma display device.
Figure 5:
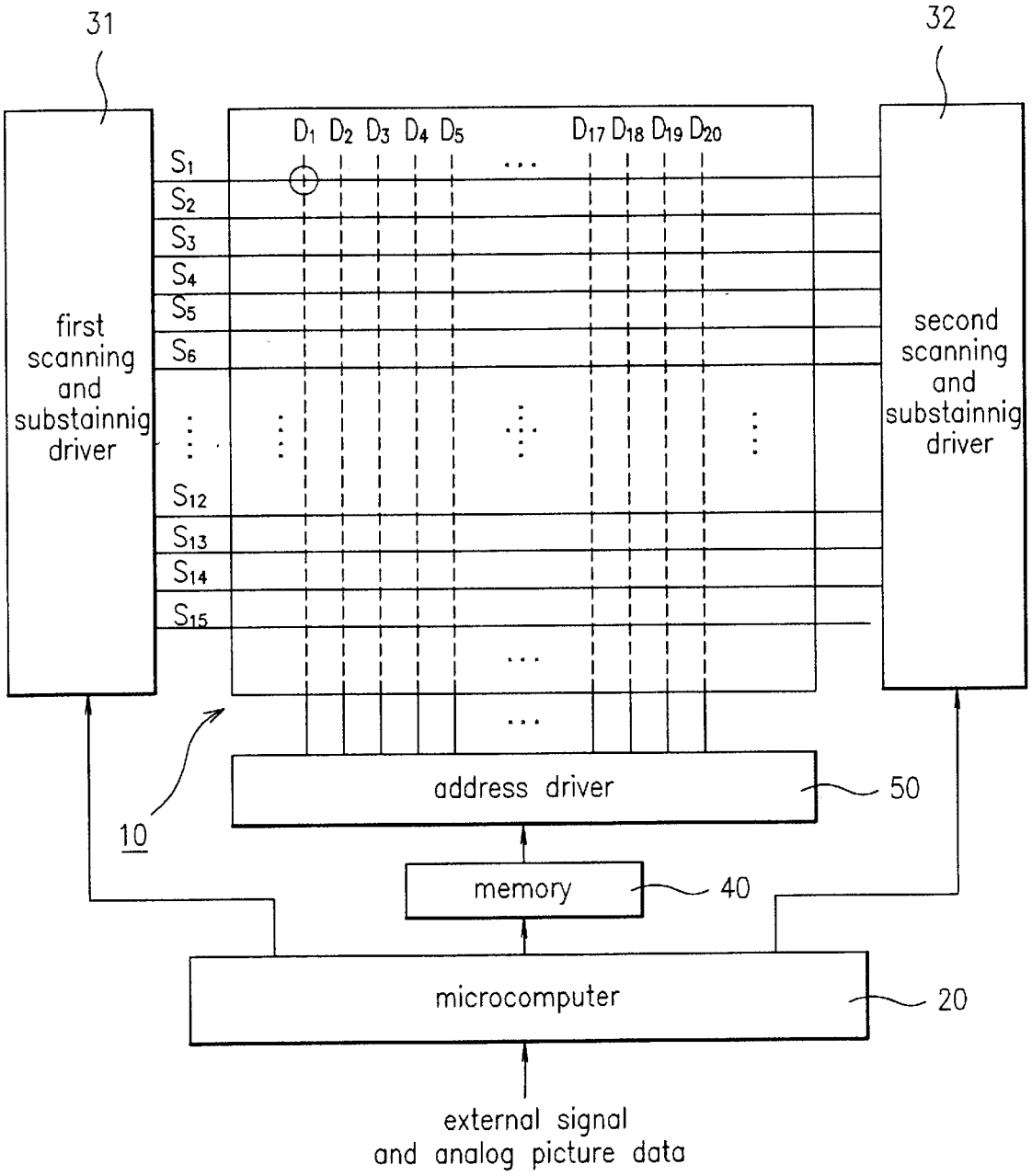
FIG. 5 is a schematic block diagram of a circuit for driving a plasma display device according to the present invention.

As shown in FIG. 5, the circuit for driving a plasma display device according to the present invention includes a micom 20 for digitizing analog picture data to output digital picture data and outputting various control signals according to the digital picture data and external signals, a first scanning and sustaining driver 31 for sequentially erasing each two lines for every 1/15 frame (to be referred to as one horizontal period, hereinafter) from the first horizontal lines ($S_1$, $S_{13}$) to the last fifteenth ones ($S_{15}$, $S_{12}$), each included in subframes 1 and 3 SF1 and SF3 among four subframes SF1 to SF4, according to the control signal of the micom 20, scanning the same, and supplying sustain pulses for sustaining discharge to the scanned horizontal electrode lines, a second scanning and sustaining driver 32 for sequentially erasing each two lines for every one horizontal period from the first horizontal lines ($S_9$, $S_{15}$) to the last fifteenth ones ($S_8$, $S_{14}$), each included in subframes 2 and 4 SF2 and SF4 except the subframes SF1 and SF3, according to the control signal of the micom 20, scanning the same, and supplying sustain pulses for sustaining discharge to the scanned horizontal electrode lines, a memory 40 for dividing a memory region into two subfield regions sf1 and sf2 under the control of the micom 20, dividing total horizontal lines of one frame into first to fourth subframes SF1 to SF4 according to the relative luminance ratio, and allotting different subframes to the respective subfields to then store the digital picture data output from the micom 20, and an address driver 50 for receiving bit values of 20 digital picture data corresponding to the horizontal electrode line currently scanned by the first and second scanning and sustaining drivers 31 and 32 from the memory 40 and supplying the same to 20 vertical electrode lines $D_1$ to $D_{20}$ formed in an AC PDP 10, respectively.

Figure 6A:
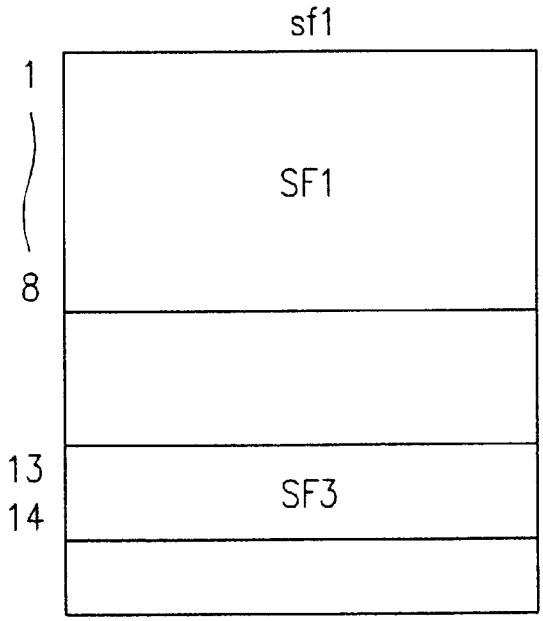
FIGS. 6A and 6B are view diagrams illustrating 16 gray scale implementation according to an embodiment of the present invention.
Figure 6B:
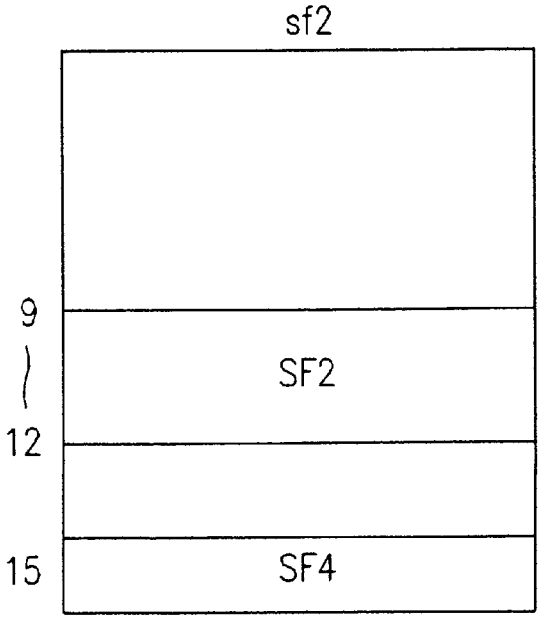
Figure 7A:
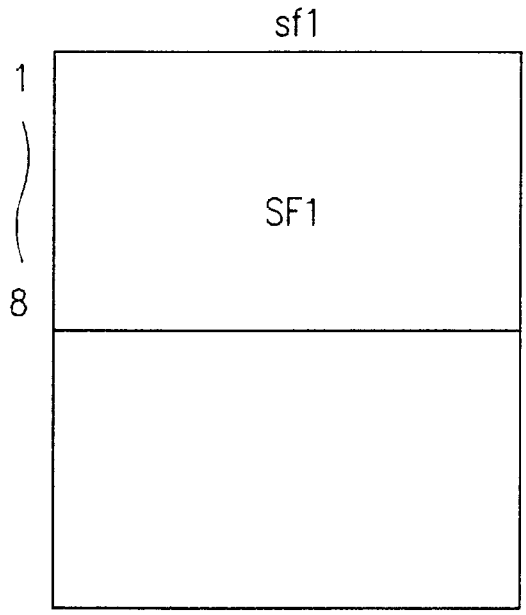
FIGS. 7A through 7D are view diagrams illustrating 16 gray scale implementation according to another embodiment of the present invention.
Figure 7B:
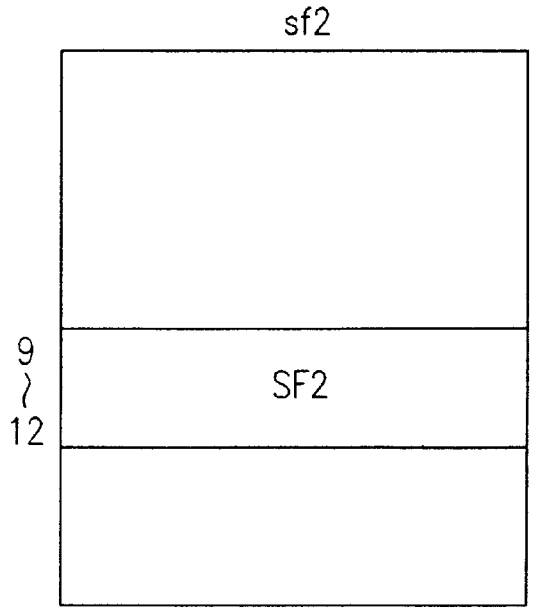
Figure 7C:
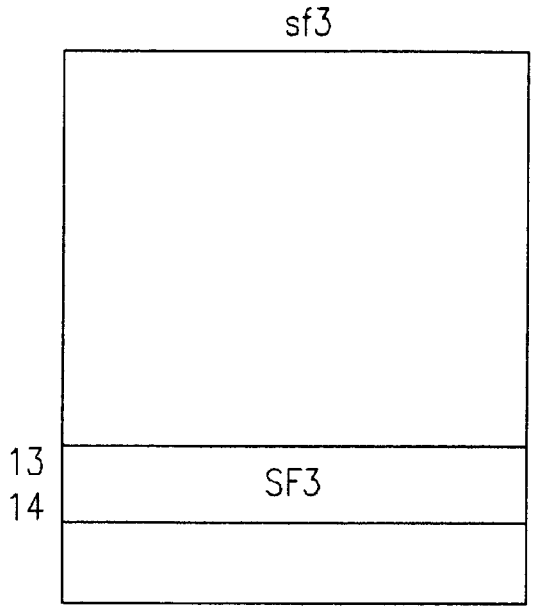
Figure 7D:
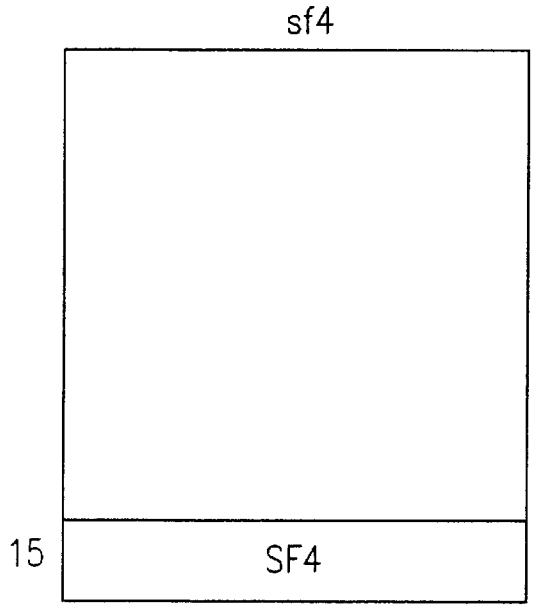

The driving circuit of the plasma display device having the aforementioned configuration according to an embodiment of the present invention will now be described in detail with reference to FIGS. 6A and 6B.

First, as described in the conventional art, assuming that total horizontal lines of one frame is 15, one frame is divided into four subframes SF1, SF2, SF3 and SF4 according to the relative luminance ratio 1:2:4:8. Eight horizontal lines 1 to 8, four horizontal lines 9 to 12, two horizontal lines 13 and 14 and one horizontal line 15 are included in the first, second, third and fourth subframes SF1, SF2, SF3 and SF4, respectively.

At this time, the memory 40 divides a memory region into first and second subfield regions, that is, one frame divided into four subframes SF1 to SF4, and two different subframes allotted to the respective subfields sf1 and sf2. For example, as shown in FIGS. 6A and 6B, the first and third subframes SF1 and SF3 are allotted to the first subfield sf1, and the second and fourth subframes SF2 and SF4 are allotted to the second subfield sf2.

Therefore, while each four horizontal lines are being sequentially scanned from the first horizontal lines 1, 9, 13 and 15 to the last ones 15, 8, 12 and 14, positioned right before the first lines, included in the respective subframes SF1 to SF4, during one horizontal period, by alternatively driving the first and second subfields sf1 and sf2, if the corresponding gray scale data are supplied, the scanning frequency is decreased and a display picture of $2^4$ (=16) gray scale levels can be implemented.

In other words, the micom 20 digitizes externally input analog picture data to then output 4-bit digital picture data $B_1$, to $B_4$ and outputs various control signals according to the digital picture data and external signals.

At this time, the digital picture data $B_1$ to $B_4$ output from the micom 20 are stored in the corresponding subframes allotted to the first and second subfields sf1 and sf2 of the memory 40, respectively. Here, the data are stored by frames, colors and bits.

Thereafter, according to the control signals output from the micom 120, the first and second scanning and sustaining drivers 31 and 32 repeatedly turn the entire screen of the AC PDP 10 on and off, thereby forming a wall charge within the discharge space of each cell. Then, each two lines from each first horizontal electrode lines 1 and 13 to the last fifteenth horizontal electrode lines 15 and 12, included in the first and third subframes SF1 and SF3 allotted to the first scanning and sustaining driver 31, respectively, are sequentially erased for every one horizontal period, and then scanned. At the same time, each two lines from each first horizontal electrode lines 9 and 15 to the last fifteenth horizontal electrode lines 8 and 14, included in the second and fourth subframes SF2 and SF4 allotted to the second scanning and sustaining driver 32, respectively, are sequentially erased for every one horizontal period, and then scanned. Also, the first and second scanning and sustaining drivers 31 and 32 scan the respective horizontal lines 1 to 15 and then supply sustain pulses, so that a logic 'high' signal is supplied through the corresponding vertical electrode lines among 20 cells corresponding to the respective horizontal lines 1 to 15, thereby sustaining discharge and emission of partial cells experiencing address discharge for a predetermined time.

The address driver 50 supplies to 20 vertical electrode lines $D_1$ to $D_{20}$ bit values of 20 digital picture data corresponding to the horizontal electrode line currently scanned by the first and second scanning and sustaining drivers 31 and 32, thereby displaying a picture of 16 (=$2^4$) gray scale levels on the AC PDP 10. At this time, the address driver 50, as explained in the conventional art, supplies the least significant bit $B_1$ among corresponding 20 digital picture data to the vertical electrode lines $D_1$ to $D_{20}$ while 15 horizontal electrodes lines $S_1$ to $S_{15}$, included in the first subframe SF1, are sequentially scanned, supplies the most significant bit $B_4$ while 15 horizontal electrodes lines $S_9$ to $S_8$, included in the second subframe SF2, are sequentially scanned, supplies the third bit $B_3$ while 15 horizontal electrodes lines $S_{13}$ to $S_{12}$, included in the third subframe SF3, are sequentially scanned, and supplies the second bit $B_2$ while 15 horizontal electrodes lines $S_{15}$ to $S_{14}$, included in the fourth subframe SF4, are sequentially scanned.

In more detail, while the first and second subfields sf1 and sf2 are alternatively driven at two times during one horizontal period by the first and second scanning and sustaining drivers 31 and 32, that is, in the order of sf1 sf2 sf1 sf2, and the first horizontal lines 1, 9, 13 and 15 respectively included in four subframes SF1 to SF4 are scanned during two time driving of the respective subfields sf1 and sf2, the corresponding gray scale data are supplied.

The scanning order of the first horizontal lines 1, 9, 13 and 15 is 1 to 9 to 13 to 15.

Thereafter, while the first and second subfields sf1 and sf2 are alternatively driven by two times during one horizontal period (sf1 sf2 sf1 sf2) until the last horizontal lines 15, 8, 12 and 14 are scanned so that each four horizontal lines are sequentially scanned during one horizontal period for 15 cycles, if the corresponding gray scale data are supplied, a picture of 16 gray scale levels is displayed.

The scanning order of four horizontal electrode lines scanned during one horizontal period does not affect the gray scale implementation. Thus, the first and second subfields may be driven in the order of sf2 sf1 sf2 sf1.

Also, each four horizontal lines can be scanned during one horizontal period such that the first and second subfields sf1 and sf2 are sequentially driven once during one horizontal period and each two horizontal lines are scanned at the driving time of the respective subfields sf1 and sf2. For example, the first horizontal lines 1, 9, 13 and 15 are scanned in the order of 1 to 13 to 9 to 15.

As described above, since four horizontal electrode lines to be scanned during one horizontal period by two subfields sf1 and sf2 are scanned by each two lines, 16 gray scales which is the same as in the conventional technology can be implemented and the overall scanning frequency is decreased to a half that of the conventional technology, According to another embodiment of the present invention, there are provided two scanning and sustaining drivers. Then, instead of allotting four subframes to the respective subfields sf1 and sf2 by two, one and three subframes, or three and one subframes may be allotted for obtaining the same effect of decreasing the scanning frequency as that in the first embodiment of the present invention.

Also, according to still another embodiment of the present invention, there are provided four scanning and sustaining drivers. Four subframes are allotted one by one to four subfields, respectively, to then be separately driven. Then, the scanning frequency is decreased to a fourth that in the conventional technology. In other words, as shown in FIGS. 7A through 7D, one frame is divided into four subfields sf1, sf2, sf3 and sf4, first, second, third and fourth subframes SF1, SF2, SF3 and SF4 are allotted to the subfields sf1, sf2, sf3 and sf4, respectively. Then, if four horizontal lines to be scanned during one horizontal period are scanned one by one at the driving time of the respective subfields sf1 to sf4, the overall scanning frequency is decreased to a fourth that in the conventional gray scale implementing method using the sub-frame method.

To implement 256 gray scales by a similar method to that of the aforementioned 16 gray scale implementing method according to the present invention, total horizontal lines of one frame is divided into 8 subframes according to a relative luminance ratio 1:2:4:8:16:32:64:128, each frame is divided into 2, 4 or 8 subfields and then different subframes are allotted to each subfield by four, two or one.

Thereafter, while the subfields divided into 2, 4 or 8 are sequentially driven to scan each 8 horizontal lines during one sustaining period, if the corresponding gray scale data are supplied, a display picture of 256 gray scale levels can be implemented. In this case, it is easily appreciated that the overall scanning frequency becomes lowest when one frame is divided into 8 subfields. Also, the number of subfields divided in one frame and the number of subframes allotted to each subfield can be obtained by the following equation:

$$G=2^{X\cdot Y} \quad (1)$$

where X denotes the number of subfields, Y denotes the number of write pulses scanned to the subfields and G denotes gray scales.

Therefore, to implement 256 gray scales, values of X and Y can be set to X=1 and Y=8, X=2 and Y=4, X=4 and Y=2, or X=8 and Y=1, respectively.

Using such a method, higher gray scales, that is, $256 \leqq G \leqq 65536$, can be implemented.

In other words, in the case of 65536 gray scales, total horizontal lines of one frame are divided into 16 subframes according to a relative luminance ratio 1:2:4:8:16:32:128:256:512:1024:2048:4096:8192:16384:32768, and then each frame is divided into 2, 4, 8 or 16 subfields. Then, different subframes are allotted to the respective subfields by 8, 4, 2 or 1.

Thereafter, while the subfields divided into 2, 4, 8 or 16 are sequentially driven to scan each 16 horizontal lines during one horizontal period, the corresponding gray scale data are supplied, thereby implementing a display picture of 65536 gray scale levels.

In the case of implementing 65536 gray scales in the abovedescribed manner, if one frame is divided into 2 subframes, the overall scanning frequency is decreased to a half (½) that in the conventional gray scale implementing method using the sub-frame method. If one frame is divided into 4 subframes, the overall scanning frequency is decreased to a fourth (¼) that in the conventional gray scale implementing method. If one frame is divided into 8 subframes, the overall scanning frequency is decreased to one eighth (⅛) that in the conventional gray scale implementing method. If one frame is divided into 16 subframes, the overall scanning frequency is decreased to a sixteenth (1/16) that in the conventional gray scale implementing method. Therefore, 65536 grays scales are easily implemented without destabilizing the system.

As described above, according to the driving circuit for a plasma display device and a gray scale implementing method of the present invention, total horizontal lines of one frame are divided into a plurality of subframes according to a relative luminance ratio, each frame is divided into at least two subfields, different subframes are allotted to each subfield, and then a plurality of horizontal lines to be scanned during one horizontal period in a sub-frame method are separately scanned at the driving time of each subfield by means of at least two scanning and sustaining drivers, thereby decreasing the overall scanning frequency. Therefore, higher gray scales exceeding 256 levels can be easily implemented by a stable system.

Also, since gray scales are implemented by fewer subfields than those of the conventional sub-field method, noise and flicker of a picture can be eliminated. Accordingly, even if the number of horizontal electrode lines is increased, the time required for scanning can be reduced, thereby preventing the lowering of luminance and contrast of a PDP.

What is claimed is:

1. A circuit for driving a plasma display device for implementing gray scales on an alternating current plasma display panel (AC PDP) where M vertical electrode lines and N horizontal electrode lines are formed, said circuit comprising:

a controller for digitizing analog picture data to output digital picture data and outputting various control signals according to said digital picture data and external signals;

a memory for dividing one frame into X subfields according to the control signal of said controller, dividing total horizontal lines of one frame into X·Y subframes according to relative luminance ratio and then allotting Y different subframes to the respective subfields; X scanning and sustaining drivers for sequentially erasing each Y lines for every $\frac{1}{2}^{X\cdot Y}-1$ frame from the first horizontal electrode lines to the last Nth horizontal electrode lines, included in Y different subframes allotted to the respective subfields, scanning the same and supplying sustain pulses for sustaining discharge in scanned horizontal electrode lines; and an address driver for receiving bit values of M digital picture data corresponding to the horizontal electrode line currently scanned by said X scanning and sustaining drivers from said memory and supplying the same to said M vertical electrode lines.

2. A gray scale implementing method for a plasma display device, for implementing gray scales on an AC PDP where M vertical electrode lines and N horizontal electrode lines are formed, comprising the steps of:

(1) dividing total horizontal lines of one frame into X×Y subframes according to a relative luminance ratio;

(2) dividing each frame into X subfields and allotting Y different subframes to each subfield; and (3) supplying corresponding gray scale data while sequentially erasing each X×Y horizontal lines during one horizontal period from the first horizontal electrode lines to the last Nth horizontal electrode lines, included in Y different subframes allotted to each subfield by repeatedly driving X subfields and scanning the same, thereby implementing a display picture of $2^{X\cdot Y}$ gray scales.

3. The method of claim 2, wherein said step (3) is performed such that X subfields are alternately driven Y times during one horizontal period and one horizontal line is scanned at the driving time of each subfield to scan each X×Y horizontal lines during one horizontal period.

4. The method of claim 2, wherein in said step (3), X subfields are sequentially driven once at a time and Y horizontal lines are scanned at a driving time of each subfield to scan X×Y horizontal lines at a time.

5. A method for implementing a plurality of gradations in a plasma display device, comprising:

partitioning a frame of data into a plurality of subframes, each subframe corresponding to a different predetermined gradation;

partitioning the frame of data into a plurality of subfields; and assigning the plurality of subframes to the plurality of subfields so that a particular subframe is assigned to exactly one subfield.

6. The method of claim 5, wherein to implement $2^{X*Y}$ gradations, the frame of data is partitioned into X*Y subframes and X subfields, Y subframes being assigned to each of the X subfields, where X is an integer greater than one, and Y is an integer greater than or equal to one.

7. The method of claim 6, wherein X*Y equals 8; X equals one of 2, 4, and 8; and Y equals one of 4, 2, and 1, respectively.

8. The method of claim 6, wherein X*Y equals 16; X equals one of 2, 4, 8, and 16; and Y equals one of 8, 4, 2, and 1, respectively.

9. The method of claim 6, further comprising:

driving X*Y horizontal lines within one horizontal period.

10. The method of claim 9, wherein the driving step includes:

driving the X subfields alternately Y times each; and scanning one horizontal line when driving each subfield.

11. The method of claim 9, wherein the driving step includes:

driving the X subfields sequentially one time each; and scanning Y horizontal lines when driving each subfield.

12. A circuit for implementing a plurality of gradations in a plasma display device, comprising:

a memory to partition a frame of data into a plurality of subframes, each subframe corresponding to a different predetermined gradation, to partition the frame of data into a plurality of subfields, and to assign the plurality of subframes to the plurality of subfields so that a particular subframe is assigned to exactly one subfield; and a plurality of scanning and sustaining drivers, each assigned to drive at least one of the plurality of subfields.

13. The circuit of claim 12, wherein to implement $2^{X*Y}$ gradations, the memory partitions the frame of data is into X*Y subframes and X subfields, and assigns Y subframes to each of the X subfields, where X is an integer greater than one, and Y is an integer greater than or equal to one.

14. The circuit of claim 13, wherein a number of scanning and sustaining drivers equals X.

* * * * *